US007481694B1

(12) United States Patent
Benbow

(10) Patent No.: US 7,481,694 B1
(45) Date of Patent: Jan. 27, 2009

(54) REMOTE CONTROL ARMORED PERSONNEL CARRIER TOY

(76) Inventor: Jonathan W. Benbow, 518 Columbia St., Hudson, NY (US) 12534

( * ) Notice: Subject to any disclaimer, the term of this patent is extended or adjusted under 35 U.S.C. 154(b) by 569 days.

(21) Appl. No.: 11/208,931

(22) Filed: Aug. 23, 2005

(51) Int. Cl.
*A63H 30/00* (2006.01)

(52) U.S. Cl. ..... 446/454

(58) Field of Classification Search ..... None
See application file for complete search history.

(56) References Cited

U.S. PATENT DOCUMENTS

| | | | | | |
|---|---|---|---|---|---|
| D137,740 | S | * | 4/1944 | Flynt | D21/557 |
| D203,609 | S | * | 2/1966 | Pfister | D21/557 |
| D211,941 | S | * | 8/1968 | Barr et al. | D12/12 |
| 3,675,366 | A | * | 7/1972 | Tomiyama | 446/434 |
| D290,479 | S | * | 6/1987 | Jones et al. | D21/557 |
| D425,140 | S | * | 5/2000 | Bao | D21/539 |
| 2001/0049249 | A1 | * | 12/2001 | Tachau et al. | 446/397 |
| 2002/0123297 | A1 | * | 9/2002 | Hornsby et al. | 446/484 |
| 2005/0042974 | A1 | * | 2/2005 | Agostini et al. | 446/272 |
| 2006/0009118 | A1 | * | 1/2006 | Fosbenner et al. | 446/438 |

FOREIGN PATENT DOCUMENTS

EP 700703 A2 * 3/1996

* cited by examiner

*Primary Examiner*—Robert E Pezzuto
*Assistant Examiner*—Tramar Harper
(74) *Attorney, Agent, or Firm*—Crossley Patent Law; Mark A. Crossley

(57) ABSTRACT

A remote control armored personnel carrier toy with trailer. The carrier and trailer feature multiple armaments, operational lights and rotatable cannons. Servos are used to control the functions of the carrier and trailer via the remote control dictations through airwaves. Both combustible fuel and electrically driven carriers are offered.

20 Claims, 6 Drawing Sheets

REMOTE CONTROL ARMORED PERSONNEL CARRIER TOY

BACKGROUND OF THE INVENTION

Remote control toys, often referred to as RC toys, are available in many forms. Each may have its own particular functions and appeal to children and adults who enjoy their operation. None offer the particular appearance and functions of the current invention.

FIELD OF THE INVENTION

The invention relates to remote control toys and more specifically to an armored personnel carrier with trailer.

SUMMARY OF THE INVENTION

The general purpose of the remote control armored personnel carrier toy, described subsequently in greater detail, is to provide a remote control armored personnel carrier toy which has many novel features that result in an improved remote control armored personnel carrier toy which is not anticipated, rendered obvious, suggested, or even implied by prior art, either alone or in combination thereof.

To accomplish this, the invention comprises a toy version of an armored personnel carrier. The carrier features a plurality of armaments. The four wheeled carrier offers a functional realism which can entertain children and hobbyists alike. The carrier pulls a trailer that is also heavily armed with realistically appearing armaments. The stand of the trailer is even extended, in further realistic fashion. The preferred example of the invention uses a multi-channel remote control such that a plurality of servos within the carrier and trailer are operational. Features of the carrier and trailer are then even more realistic. The carrier is controlled by speed and direction in both forward and reverse. The missile launchers of the carrier and the trailer are operational via servos controlled by the remote control. The lights of both the carrier and trailer are optionally functional and controlled via the remote control. The carrier of the invention is offered in both combustible fuel and electric examples. The invention utilizes powering, servos, and remote controls that are known in the art.

Thus has been broadly outlined the more important features of the remote control armored personnel carrier toy so that the detailed description thereof that follows may be better understood and in order that the present contribution to the art may be better appreciated.

Numerous objects, features and advantages of the remote control armored personnel carrier toy will be readily apparent to those of ordinary skill in the art upon reading the following detailed description of presently preferred, but nonetheless illustrative, examples of the remote control armored personnel carrier toy when taken in conjunction with the accompanying drawings. In this respect, before explaining the current examples of the remote control armored personnel carrier toy in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the remote control armored personnel carrier toy. It is therefore important that the claims be regarded as including such equivalent constructions insofar as they do not depart from the spirit and scope of the present invention.

Objects of the remote control armored personnel carrier toy, along with various novel features that characterize the invention are particularly pointed out in the claims forming a part of this disclosure. For better understanding of the remote control armored personnel carrier toy, its operating advantages and specific objects attained by its uses, refer to the accompanying drawings and description.

DETAILED DESCRIPTION OF THE DRAWINGS

Figures 1, 2:
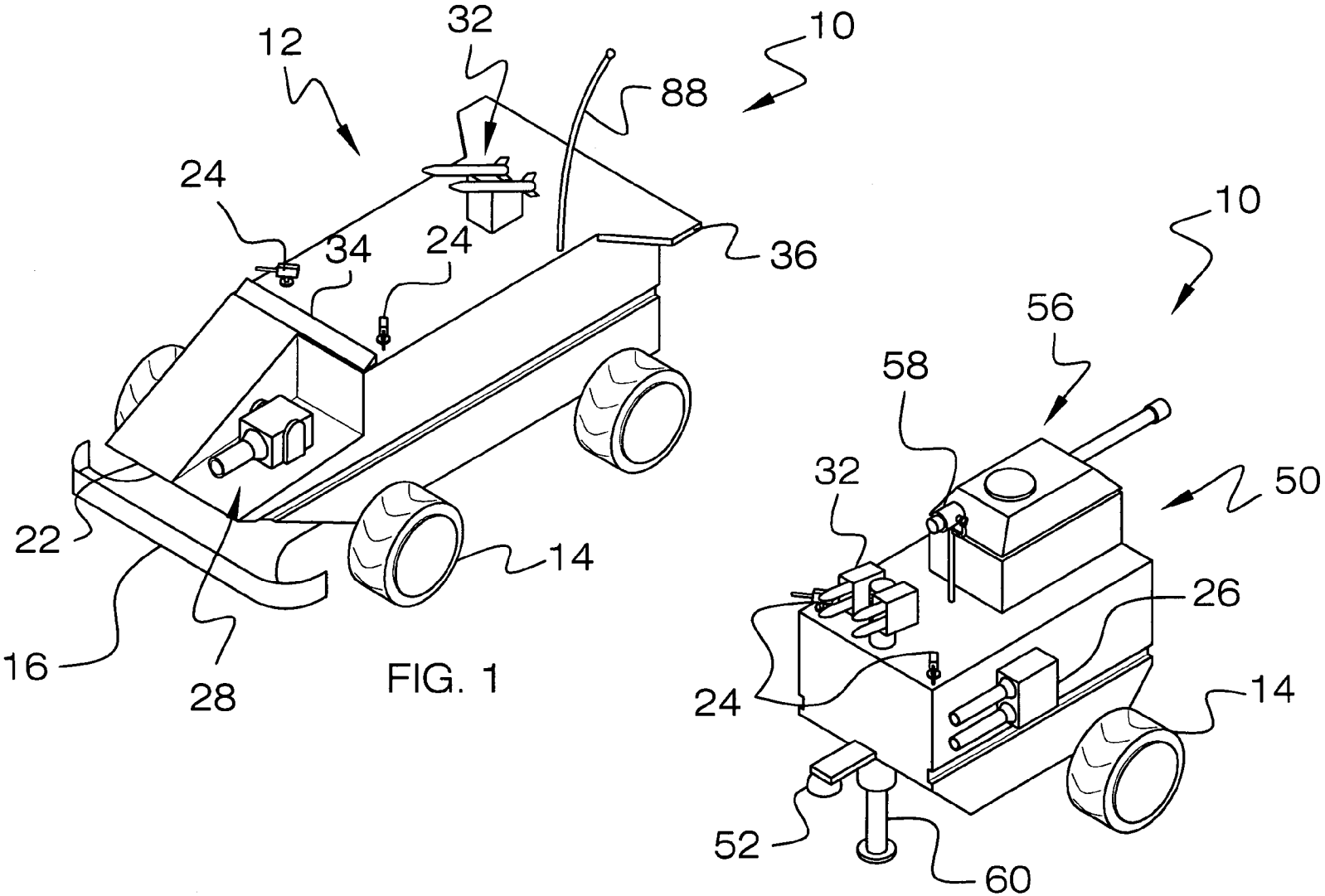
FIG. 1 is a perspective view of the armored personnel carrier of the invention.
FIG. 2 is a perspective view of the trailer of the invention.
Figure 3:
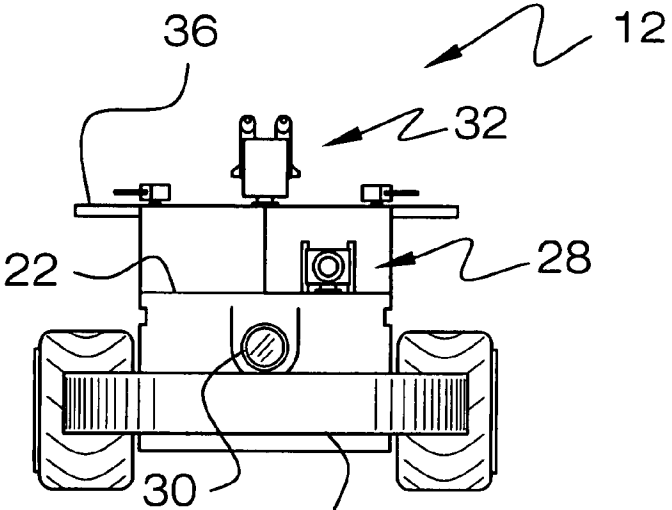
FIG. 3 is a front elevation view of the armored personnel carrier of the invention.
Figure 4:
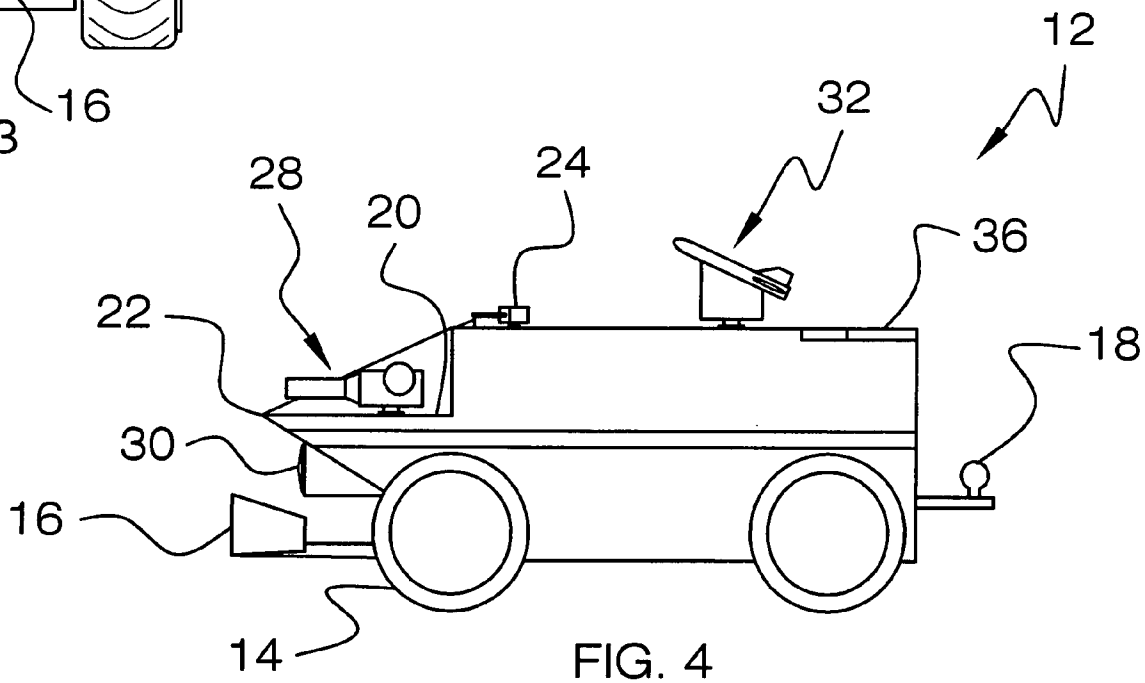
FIG. 4 is a side elevation of the armored personnel carrier of the invention.
Figure 5:
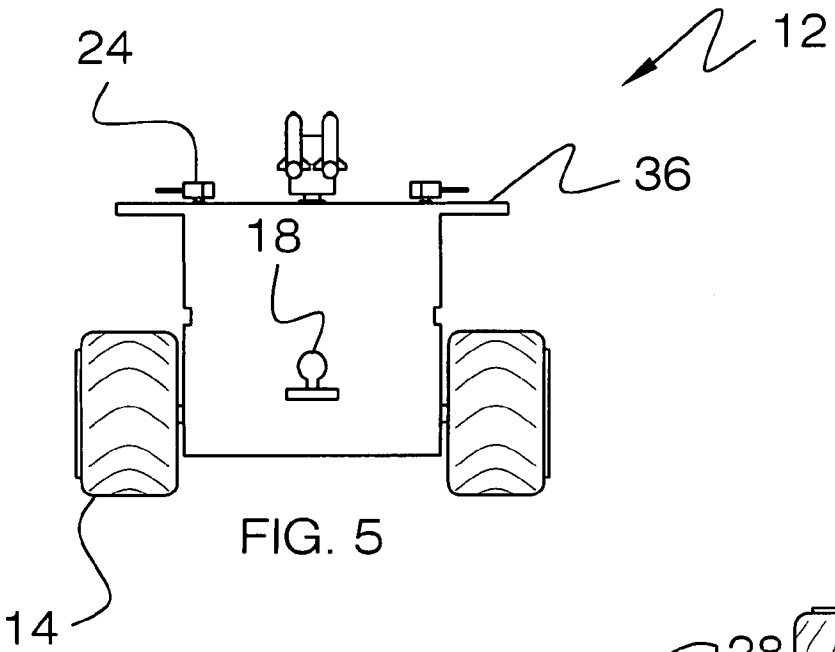
FIG. 5 is a rear elevation of the armored personnel carrier of the invention.
Figure 6:
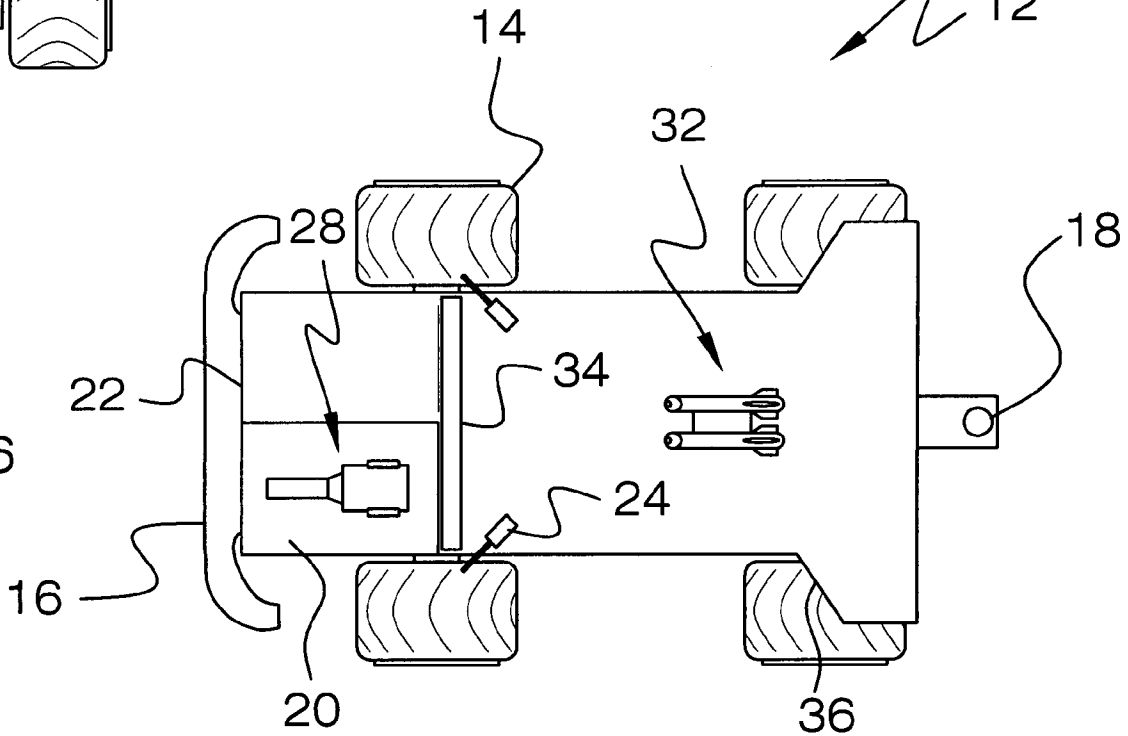
FIG. 6 is a top plan of the armored personnel carrier of the invention.
Figure 8:
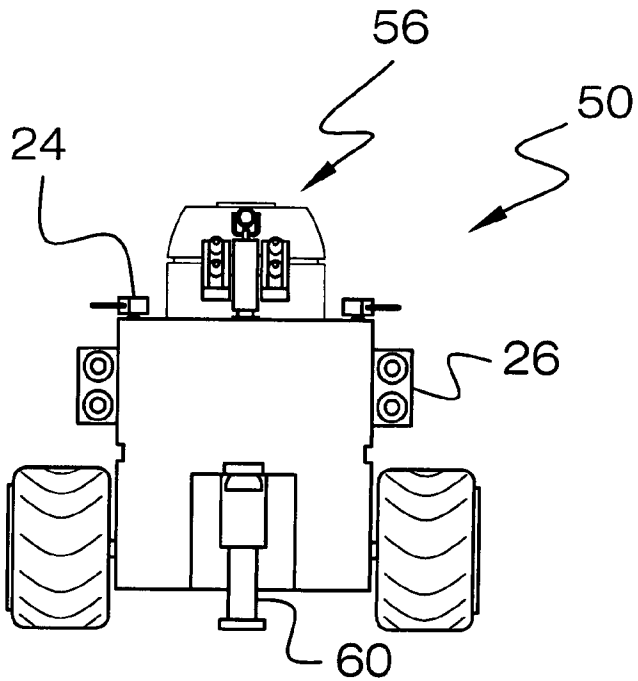
FIG. 8 is a front elevation of the trailer of the invention.
Figure 7:
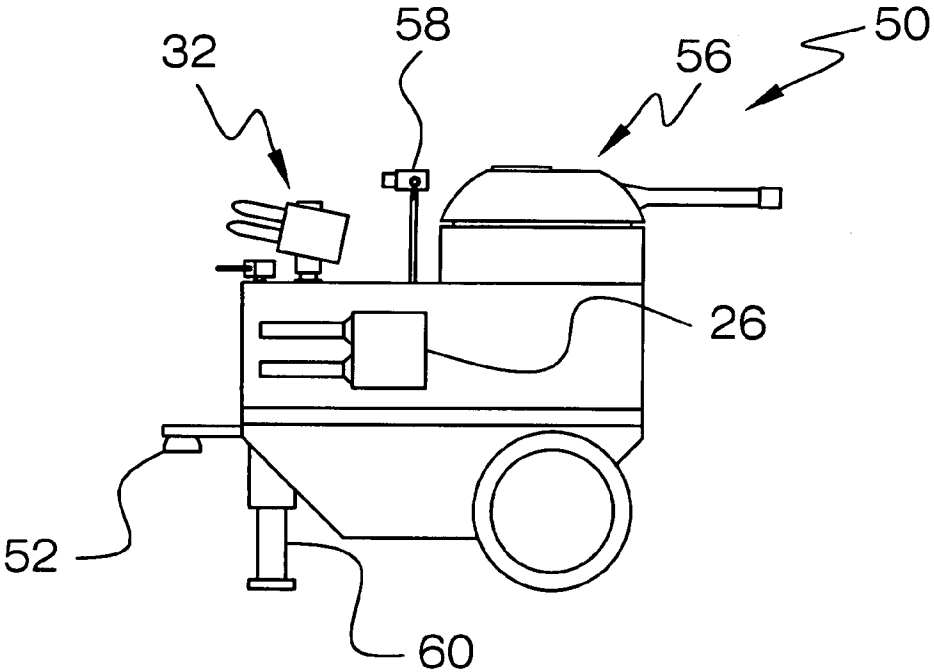
FIG. 7 is a side elevation of the trailer of the invention.
Figure 9:
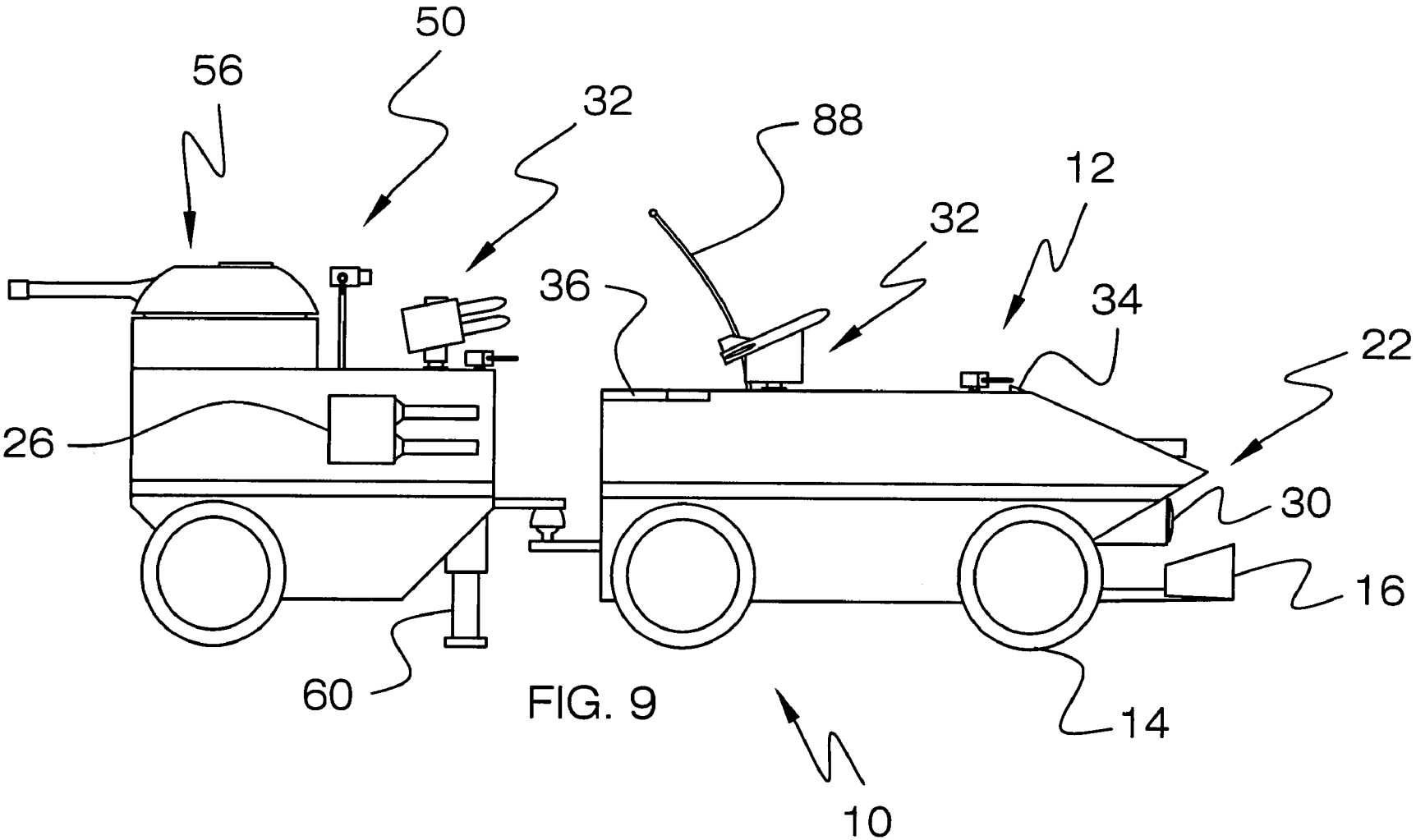
FIG. 9 is a side elevation of the trailer hitched to the armored personnel carrier.

With reference now to the drawings, and in particular FIGS. 1 through 11 thereof, example of the remote control armored personnel carrier toy employing the principles and concepts of the present invention and generally designated by the reference number 10 will be described.

Referring to FIGS. 1, 3, 4, 5, and 6, the invention 10 comprises a parallelepiped four wheeled vehicle comprises the personnel carrier 12. The carrier 12 further comprises a front wedge 22. A light 30 is disposed below the wedge 22. The light 30 is optionally powered. The carrier 12 further comprises a rear, two opposing sides, a top, and a bottom. A ram bumper 16 extends beyond the front wedge 22. A cannon platform 20 is comprised of a cutout of the front wedge 22. A rotatably movable cannon 28 is disposed on the platform 20.

Figure 11:
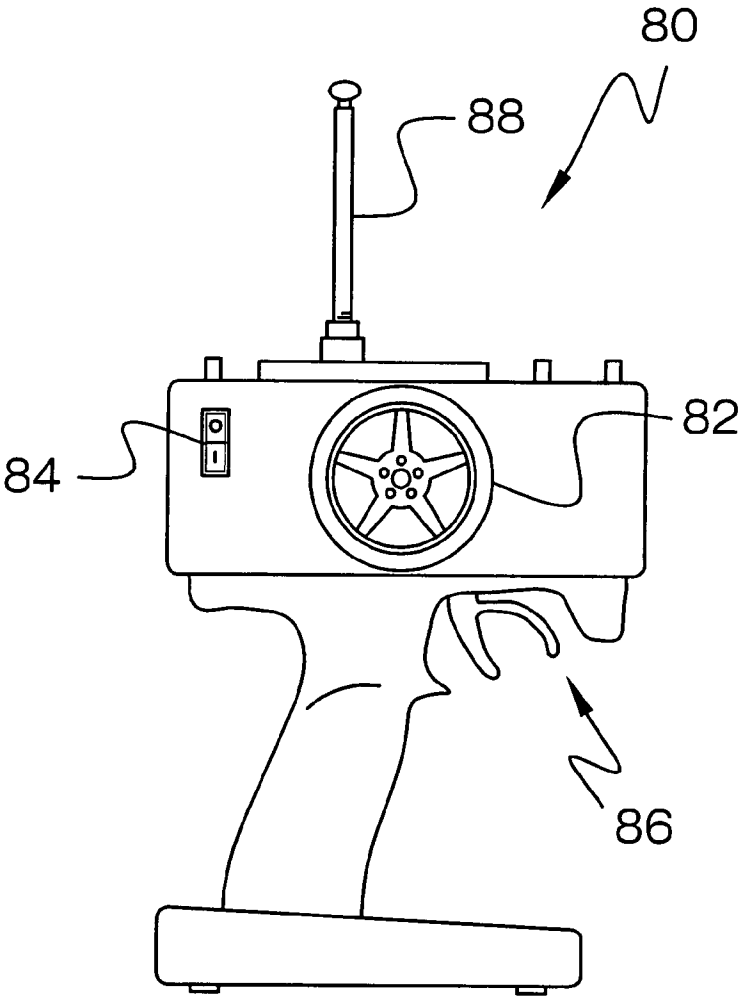
FIG. 11 is a typical remote control included with and used with the invention.

Two spaced apart small guns 24 are disposed toward the front of the top of the carrier 12. The small guns 24 are rotatable. A shield 34 is disposed in front of the small guns 24. An air foil 36 is disposed at the top rear of the carrier 12. A missile launcher 32 is rotationally disposed upon the top of the carrier 12 and is proximal to the air foil 36. The missile launcher 32 is spring loaded whereby releasing a catch provides for propelling the missiles from the missile launcher 32. The preferred example of the invention 10 provides a servo 42 for controlling the release of the missiles. Servos used are well known in the art of RC toys. Batteries (not shown) are removably held within the carrier 12. The batteries provide for the power to operate servos and to receive dictational input from the remote control 80 (FIG. 11). A male hitch 18 is affixed to the rear of the carrier 12.

Referring to FIGS. 2, 7, 8, and 9, the parallelepiped two wheeled trailer 50 has a top, a bottom, two opposite sides, a front, and a rear. A female hitch 52 is affixed to the front of the trailer 50. A retractable stand 60 is affixed at the front of the trailer 50 and is proximal to the female hitch 52. The female hitch 52 removably receives the male hitch 18 of the carrier 12. Each side of the trailer 50 is affixed with a large gun 26. A small gun 24 is rotatably disposed on each of the top front corners of the trailer 50. A rotatable missile launcher is disposed at the front top center of the trailer 50. The missile launcher 32 is spring loaded whereby releasing a catch provides for propelling the missiles from the missile launcher 32. The preferred example of the invention 10 provides a servo 42 for controlling the release of the missiles. A trailer cannon 56 is disposed at the top rear of the trailer 50. The trailer cannon 56 is rotatable. The trailer 50 rolls on two wheels 14. A spot light 58 is disposed in the center of the trailer 50 top. The trailer 50 is equipped with batteries (not shown) such that the spotlight 58 as well as the missile launcher 32 can be operational.

Figure 10:
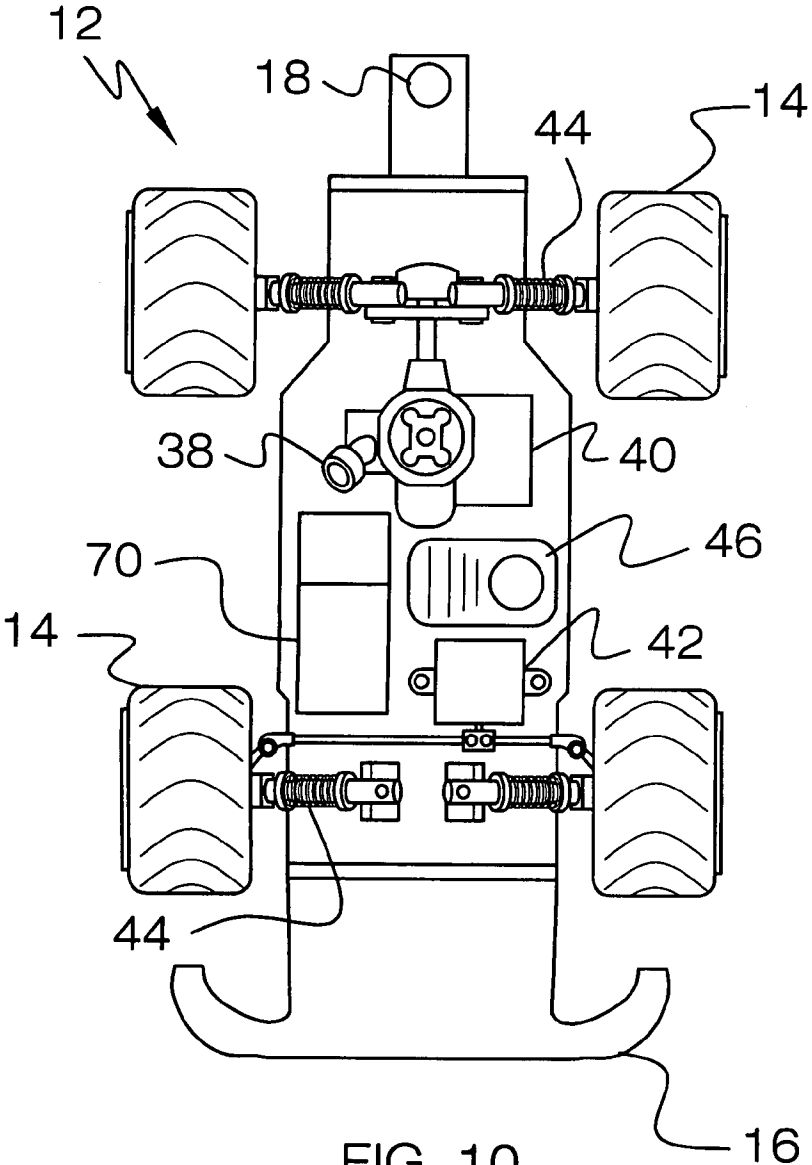
FIG. 10 is a bottom plan of the armored personnel carrier of the invention.

Referring to FIGS. 10 and 11, the carrier 12 underside details the coil over shocks 44 that suspend the 4 wheels 14 from the carrier 12. The bottom of the carrier 12 also comprises the servo 42 for controlling the steering of the carrier 12. The servo is typical in the art. Also visible is the fuel tank 46. This example of the invention is powered by a combustible fuel engine 40. Petroleum distillates and alcohol are typically used fuels in the art. The air filter 38 is disposed on the bottom of the carrier 12 but can be located elsewhere in further examples of the invention 10. The receiver 90 receives radio wave dictation from the remote control 80. The remote control 80 is comprised partially of the antenna 88, the on/off 84, the steering 82, and the speed/direction control 86. The speed/direction control 86 dictates the speed and direction of the carrier 12. Pushing the trigger of the speed/direction control 86 forward causes the carrier 12 to operate in reverse. Pulling the trigger back causes the carrier 12 to go forward. The farther the speed/direction control 86 is pushed, the faster the carrier 12 operates. The remote control 80 is only one example of a plurality of remote controls 80 offered in the art. More channels (not shown) of remote controls 80 offer more controlling mechanisms for the carrier 12. Added channels provide for controlling elements such as the carrier light 30, the missile launchers 32, as well as controlling the rotation of the various armaments of the invention 10. Further examples of the carrier 12 are powered by electric motors (not shown) which is also typical in the art of RC toys. The examples of the carriers 12 powered by electric motors house additional batteries (not shown) that are common in the art.

With respect to the above description then, it is to be realized that the optimum dimensional relationships for the parts of the remote control armored personnel carrier toy, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A toy remote control armored personnel carrier with trailer comprising:

a parallelepiped four wheeled vehicle comprising the carrier, the vehicle having a wedge shaped front, a rear, two opposing sides, a top, and a bottom;

a ram bumper extended beyond the wedge shaped front;

a cannon platform comprised of a cutout of the wedge shaped front;

a rotatably movable cannon on the platform;

a plurality of guns disposed upon the top of the carrier;

a missile launcher disposed upon the top of the carrier;

powering means for the carrier;

controlling means for the carrier, the controlling means controlling steering, speed, and direction;

a remote control for dictating to the controlling means of the carrier;

a male trailer hitch at the rear of the carrier;

a parallelepiped two wheeled trailer, the trailer having a top, a bottom, two opposite sides, a front, and a rear;

a female hitch on the front of the trailer, the female hitch for removable engagement of male hitch of the carrier;

a retractable stand at the front of the trailer, the stand affixed proximally to the female hitch; and a plurality of guns disposed on the trailer.

2. The invention in claim 1 wherein the carrier further comprises a light below the front wedge of the carrier.

3. The invention in claim 2 wherein the carrier further comprises an air foil disposed at the top rear of the carrier.

4. The invention in claim 1 wherein the plurality of guns disposed atop the carrier comprises at least two small guns;

a shield disposed in front of the guns.

5. The invention in claim 4 wherein the carrier further comprises an air foil disposed at the top rear of the carrier.

6. The invention in claim 1 wherein the plurality of guns disposed atop the carrier comprises at least two small guns;

a shield disposed in front of the guns.

7. The invention in claim 6 wherein the carrier further comprises an air foil disposed at the top rear of the carrier.

8. The invention in claim 1 wherein the carrier further comprises an air foil disposed at the top rear of the carrier.

9. A toy remote control armored personnel carrier with trailer comprising:

a parallelepiped four wheeled vehicle comprising the carrier, the vehicle having a wedge shaped front, a rear, two opposing sides, a top, and a bottom;

coil over shocks suspending each of the four wheels of the carrier;

a ram bumper extended beyond the wedge shaped front;

a cannon platform comprised of a cutout of the wedge shaped front;

a rotatably movable cannon on the platform;

a plurality of guns disposed upon the top of the carrier;

an air foil disposed at the top rear of the carrier;

a missile launcher disposed upon the top of the carrier;

powering means for the carrier;

a plurality of controlling servos for the carrier, the controlling servos controlling steering, speed, direction, and the missile launcher;

a remote control for dictating to the controlling means of the carrier;

a receiver affixed to the carrier, the receiver for receiving dictation from the remote control;

a male trailer hitch at the rear of the carrier;

a parallelepiped two wheeled trailer, the trailer having a top, a bottom, two opposite sides, a front, and a rear;

a female hitch on the front of the trailer, the female hitch for removable engagement of male hitch of the carrier;

a retractable stand at the front of the trailer, the stand affixed proximally to the female hitch; and a plurality of guns disposed on the trailer.

10. The invention in claim 9 wherein the carrier further comprises a light below the front wedge of the carrier.

11. The invention in claim 10 wherein the plurality of guns disposed atop the carrier comprises at least two small guns;

a shield disposed in front of the guns.

12. The invention in claim 11 wherein the top of the trailer further comprises a rotatable spotlight.

13. The invention in claim 12 wherein the carrier is powered by a combustible fuel engine.

14. The invention in claim 12 wherein the carrier is powered by an electric engine.

15. The invention in claim 10 wherein the top of the trailer further comprises a rotatable spotlight.

16. The invention in claim 15 wherein the carrier is powered by a combustible fuel engine.

17. The invention in claim 15 wherein the carrier is powered by an electric engine.

18. The invention in claim 9 wherein the top of the trailer further comprises a rotatable spotlight.

19. The invention in claim 18 wherein the carrier is powered by a combustible fuel engine.

20. The invention in claim 18 wherein the carrier is powered by an electric engine.

* * * * *